US012145786B2

(12) United States Patent
Horowitz et al.

(10) Patent No.: US 12,145,786 B2
(45) Date of Patent: Nov. 19, 2024

(54) OPTIMIZED PACKAGING FOR LEAFY GREEN PRODUCTS

(71) Applicant: Local Bounti Operating Company, LLC, Hamilton, MT (US)

(72) Inventors: Ari Horowitz, Brooklyn, NY (US); Joshua White, Boca Raton, FL (US)

(73) Assignee: Local Bounti Operating Company, LLC, Hamilton, MT (US)

( * ) Notice: Subject to any disclaimer, the term of this patent is extended or adjusted under 35 U.S.C. 154(b) by 0 days.

(21) Appl. No.: 17/974,774

(22) Filed: Oct. 27, 2022

(65) Prior Publication Data

US 2023/0139163 A1 May 4, 2023

Related U.S. Application Data

(60) Provisional application No. 63/275,755, filed on Nov. 4, 2021.

(51) Int. Cl.
*B65D 77/20* (2006.01)
*B65D 21/02* (2006.01)
*B65D 81/26* (2006.01)

(52) U.S. Cl.
CPC ..... *B65D 77/2096* (2013.01); *B65D 21/0213* (2013.01); *B65D 81/263* (2013.01)

(58) Field of Classification Search
CPC .. B65D 77/2096; B65D 77/20; B65D 85/345; B65D 85/505; B65D 81/26; B65D 81/24
USPC ..... 206/432, 503; 220/625
See application file for complete search history.

(56) References Cited

U.S. PATENT DOCUMENTS 4,055,672 A * 10/1977 Hirsch ..... B65D 81/24 426/123
5,145,065 A * 9/1992 Mizutani ..... G03C 3/00 206/407
7,067,084 B1 * 6/2006 Leroy ..... B65D 75/32 435/243
7,828,197 B2 * 11/2010 Schuetz ..... B65D 51/249 229/125.05
8,186,391 B2 * 5/2012 Wilson ..... A47J 47/06 141/2
9,546,033 B2 * 1/2017 Everingham ..... B65D 81/3294
2002/0107127 A1 * 8/2002 Buisson ..... B65D 77/20 493/80
2002/0172834 A1 * 11/2002 Rivett ..... B32B 27/32 428/515
2004/0206637 A1 * 10/2004 Sierra-Gomez .... B65D 75/5838 206/1.5
2005/0233036 A1 10/2005 Feldmeier et al.
2007/0160805 A1 7/2007 Lin
(Continued)

OTHER PUBLICATIONS

International Search Report and Written Opinion issued on Feb. 1, 2023, in corresponding International Application No. PCT/US2022/048802, 7 pages.

*Primary Examiner* — Ernesto A Grano
*Assistant Examiner* — Symren K Sanghera
(74) *Attorney, Agent, or Firm* — Maier & Maier, PLLC

(57) ABSTRACT

According to at least one exemplary embodiment, optimized packaging may be provided. Optimized packaging may be used, for example, as packaging for leafy green products, produce, or other food items. The optimized packaging may have a frame element and one or more film surfaces.

6 Claims, 3 Drawing Sheets

(56) References Cited

U.S. PATENT DOCUMENTS

| | | | | |
|---|---|---|---|---|
| 2007/0272688 | A1* | 11/2007 | Longo | B29C 66/72341 220/4.23 |
| 2008/0176036 | A1* | 7/2008 | Mitchell | B32B 3/10 428/137 |
| 2009/0039076 | A1* | 2/2009 | Maslowski | A47J 36/027 219/734 |
| 2011/0253562 | A1* | 10/2011 | Machado | B65B 25/041 53/474 |
| 2012/0187122 | A1* | 7/2012 | Glasow | B65B 7/16 220/359.4 |
| 2015/0136627 | A1* | 5/2015 | Sabogal | B65D 85/52 206/423 |
| 2015/0298897 | A1* | 10/2015 | Kay | B65D 85/8043 426/115 |
| 2015/0360840 | A1* | 12/2015 | Tilahun | B65D 77/28 426/112 |
| 2016/0082693 | A1* | 3/2016 | Li | B32B 27/065 428/318.6 |
| 2017/0101252 | A1* | 4/2017 | Acott | A47J 31/407 |
| 2017/0121089 | A1* | 5/2017 | Gillblad | B29C 51/266 |
| 2018/0022518 | A1* | 1/2018 | Linton | B65D 77/20 206/223 |
| 2022/0185564 | A1* | 6/2022 | Murphy | B65D 75/326 |

* cited by examiner

OPTIMIZED PACKAGING FOR LEAFY GREEN PRODUCTS

CROSS-REFERENCE TO RELATED APPLICATION

The present patent application claims benefit of priority to U.S. Provisional Patent Application No. 63/275,755 entitled "OPTIMIZED PACKAGING FOR LEAFY GREEN PRODUCTS" filed on Nov. 4, 2021, which is hereby incorporated by reference.

FIELD

An exemplary embodiment relates to the field of product packaging.

BACKGROUND

Packaging perishable and non-perishable products is an important step in a process that starts with growing or manufacturing and ends with a consumer. Typical packaging uses bags, crates, cartons, boxes and the like for handling, transporting, and marketing products. Some products may have specific packaging requirements. For example, transparent packaging may be used to allow for inspection of goods before purchasing. Soft packaging, such as in bags, may be used for flexible products, while hard plastic or cartons may have other unique advantages, such as for stacking or presenting in a market. Thus, the form of the product, the transportation methods involved, and the marketing scheme may each effect the choice of packaging.

Additional factors that may be considered may include recyclability, biodegradability, variety, sales appeal, possible shelf life, protection, identification, material required, hygiene/sanitary concerns, freshness, and production costs. Rigid and semirigid structures constructed of various plastics are known in the field. Metal containers may be strong and able to bear large amounts of weight, but may be undesirable due to high cost and limited recyclability. Cartons and cardboard containers may be recyclable, but may not be completely resealable, waterproof, or structurally sound. Stacking large amounts of cardboard containers may be impossible due to the low structural integrity typically provided by cardboard. Further, some cardboard structures may be compromised and/or harbor and grow microorganisms when exposed to certain elements, such as water.

SUMMARY

According to at least one embodiment, an optimized packaging may be provided. The optimized packaging may have a rigid frame forming an enclosed sidewall, a top opening, and a bottom opening. The rigid frame may have a first flange disposed around a top perimeter and second flange disposed around a bottom perimeter. A first film may seal the top opening by securing to the first flange and a second film may seal the bottom opening by securing to the second flange. At least one of the first film and second film may be resealable. At least one of the first film and the second film may be breathable and the material of the first film and second film may have a reduced weight compared to the material of the rigid frame.

According to another exemplary embodiment, an improved container may be provided. The improved container may have a rigid frame defining a partial perimeter of a cross-section of the improved container and a single film sealed to an edge of the rigid frame may form an enclosed container. The single film may form a top surface, bottom surface, and remaining perimeter of the cross-section of the improved container. The single film may form at least 50% of a surface area of the improved container

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Figure 1:
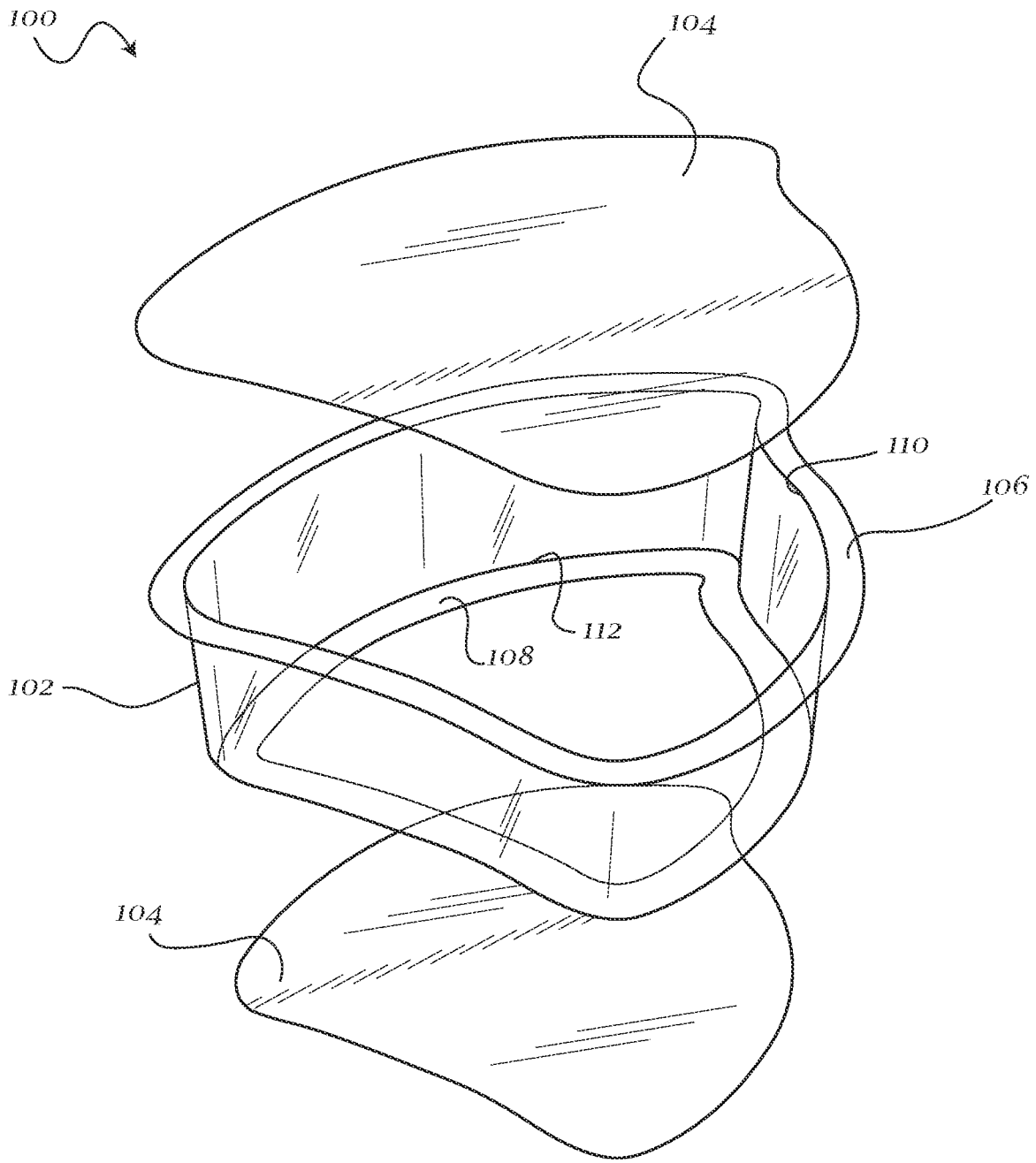
FIG. 1 is an exemplary embodiment of optimized packaging.
Figure 2:
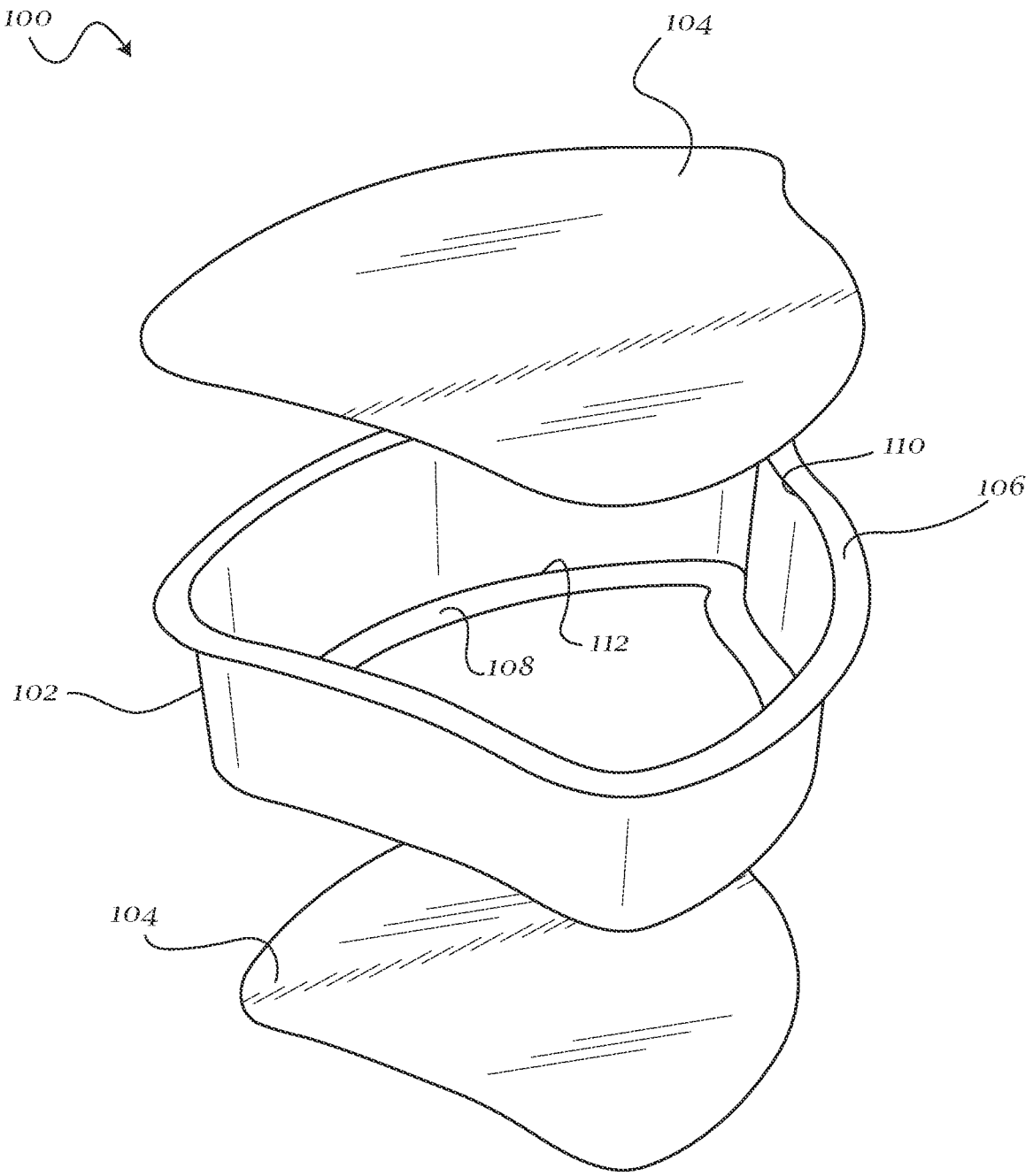
FIG. 2 is another exemplary embodiment of optimized packaging.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, optimized packaging may be provided. Optimized packaging may be used to store a variety of products. Optimized packaging may provide a container for the storage of goods, the display of goods, the shipping and transport of goods, and/or the promotion and sale of goods. According to an exemplary embodiment, optimized packaging may be used as packaging for food items, such as leafy green products, produce, or other food items. Other items may include toys, household items, pet products, personal care items, consumer products, electronics, clothing, medical products, sanitary products, cleaning products, or any other product as would be understood by a person having ordinary skill in the art.

Now referring to the Figures, optimized packaging 100 may be shown. Optimized packaging 100 may have a frame 102 and one or more film surfaces 104. According to an exemplary embodiment, optimized packaging 100 may have a first film surface 104 and a second film surface 104. In at least one exemplary embodiment, frame 102 may form a sidewall of packaging 100. Frame 102 may optionally be substantially rigid. Frame 102 may create a hollow void with first opening and a second opening on a top and bottom, respectively. Frame 102 may also have a first flange 106 for securing first film 102 and a second flange 108 for securing second film 104. According to some embodiments, there may be no flanges and films may be sealed directly to an edge of frame 102, and may be permanently sealed or resealable. According to other embodiments, there may be no flange for surfaces where a film is permanently sealed and there may be a flange where a film is resealable. Packaging 100 may be a closed solid body formed by the combination of two flexible film surfaces 104 and a rigid frame 102.

According to some exemplary embodiments, first flange 106 may protrude outward from frame 102 around a first perimeter edge 110 and second flange 108 may extend inward from frame 102 around a second perimeter edge 112 or vice versa. According to further exemplary embodiments, flange 106 and flange 108 may both extend inward, both extend outward, or may extend in both directions from frame 102. According to still further exemplary embodiments, frame 102 may not have flanges 106, 108 and film surfaces may be secured directly to frame wall 102.

Film surfaces 104, 106 may optionally be transparent, translucent or opaque and may or may not be the same. According to some exemplary embodiments, film surfaces 104 may optionally filter light, such as by color or wavelength, be tinted, or allow the passage of light, as desired to promote health and prolong shelf-life of contents of packaging 100. Transparent elements may provide for visual inspection of packaging contents. Transparent or translucent elements may also provide for sterilization after packaging, such as by ultraviolet-c radiation, sterilization lamps, or other sterilization techniques and devices as would be understood by a person having ordinary skill in the art. Frame 102 may also optionally be transparent, translucent or opaque and may or may not be the same as film surfaces 104. Film surfaces 104 may optionally be vented or may form an airtight enclosure with frame 102. According to still further exemplary embodiments, film surfaces 104 may be breathable and may allow for gas exchange between an interior and exterior of packaging 100. For example, film surfaces 104 may have vents or perforations or may be made of a material that allows for gas exchange when sealed.

According to an exemplary embodiment, packaging 100 may have a rigid frame 102 and two film surfaces 104, 106. The weight of packaging 100 may be reduced by the design and the performance with respect to product life extension may be improved. For example, the use of one film seal surface may reduce package weight by approximately 30% compared to a similarly sized clamshell package or hard plastic package, which may improve efficiencies and reduce material and shipping costs. A similarly sized package may, for example, be a package with the same total surface area. A hard plastic package may be any type of comparable plastic food packaging that has a rigid shape, as would be understood by a person having ordinary skill in the art. For purposes of comparison of material and packaging qualities described herein, hard plastic packaging may refer to a package made-up completely of the material of frame 102. Having two seals or film surfaces or arranging them to maximize a percentage of surface area may increase, multiply or double the benefit. According to at least one embodiment having two film surfaces, approximately an additional 20% reduction in total packaging weight may be achieved. The one or more film surfaces may also reduce the amount of hard plastic. According to some embodiments described herein, the film surface arrangement may reduce packaging weight by approximately 50% or more compared to a similarly sized package of hard plastic. According to other exemplary embodiments, the film surface arrangement may reduce packaging weight by at least 40%, at least 50%, at least 60%, at least 70%, at least 80%, or at least 90% compared to a similarly sized package of hard plastic. Still further, according to some embodiments, one or more film surfaces may account for at least 10%, at least 20%, at least 30%, at least 40%, at least 50%, at least 60%, at least 70%, at least 80%, or at least 90% of the surface area of packaging 100.

Two film surfaces may also increase or, according to some embodiments, double the breathable surface, which may allow better control in the container or packaging. Solid Polyethylene terephthalate (PET) elements of packaging, on the other hand, may not be able to breath. Furthermore, packaging 100 may enhance a consumer's ability to visually evaluate product quality and may provide more surface area for product description and marketing printing. Film surfaces may be easier to print or otherwise apply marketing and messaging to and therefore may add marketing value without more complexity during a sealing process. Film surfaces may also be easier to change from a manufacturing and tooling perspective as well as physically changing film surfaces on packaging to revise or change marketing or messaging. Additionally, packaging 100 may allow for innovative packaging shapes to enhance brand experience. For example, frame 102 may be shaped in any desired shape and film surfaces 104 may be sealed to frame 102, conforming to the desired shape. As shown in the Figures, a cross-sectional shape formed by frame 102 may be decorative or indicative of a product, such as a leaf. The cross-sectional shape may be a symmetrical body which may allow for convenient stacking and storing of multiple packages. According to some embodiments, the shape may be asymmetrical and may align for convenient stacking and storing by interlocking. According to still further embodiments, the shape may be symmetrical or asymmetrical and may optionally not interlock or stack. The shape of the packaging, as well as the transparent frames and surfaces, may facilitate identification of the contained goods and may allow light to penetrate the packaging.

Packaging 100 may also reduce an environmental impact of packaging 100 by minimizing packaging weight for transportation, enhancing product life cycle, minimizing waste, and utilizing recycled and bio-based materials. Packaging 100 may also provide for easy cleaning of contents and/or the packaging itself by increasing access and flow to or through the interior and/or through improved materials resistant to harboring microorganisms.

According to an exemplary embodiment, one or more of film seal/surfaces 104 may be a re-sealable seal, a single use seal, or a permanent seal. Film surfaces 104 may be sealed to frame 102 in the same manner or may be different types of seals, as detailed above. The combination of seals and the rigid frame may create a closed, solid body. Further, an exemplary embodiment may implement a solid body which may allow for convenient stacking and storing of multiple packages. The shape of the packaging, as well as the transparent frames and surfaces, may allow for light to penetrate the packaging, which may be desired when living plants are packaged. Vents within the packaging may be configured along the frame 102 in order to allow for ventilation even when multiple packages are stacked and may allow for misting or watering of living packaged plants. Alternatively, vents may be placed along the film or seal surfaces such that they are blocked and sealed until the combination of packages reach their destination or are purchased by a consumer. The rigid shape of the frame 102 may allow for multiple packages to be securely stacked on top of and next to one another. It may be contemplated that the shape of the packaging is optimized to maximize storage space, and may differ based on the contained plant.

Frame 102 may be made of any desired material as would be understood by a person having ordinary skill in the art, such as, but not limited to polyethylene terephthalate (PET), recycled PET (rPET), plastic, glass, metal, polymers, ceramics, composites, composite fibers, polymer composites, or other comparable materials to provide light weight and strong support. According to some embodiments, frame 102 may be rigid or hard material. Frame 102 may further be made of materials that resist growth and harboring of microorganisms. Film seals or surfaces 104 may similarly be made of any desired material as would be understood by a person having ordinary skill in the art, such as, but not limited to PET, rPET, metalized polyester, aluminum foil, biaxially-oriented polypropylene (BOPP), cast polypropylene (CPP), lamination and other bio-based or recycled plastics, or other comparable materials as would be understood by a person having ordinary skill in the art. Furthermore, different film seal materials may provide different levels of gas exchange, which may preserve contents as desired.

As detailed above, packaging 100 may include a resealable top, bottom, or top and bottom seal which can be opened and re-sealed by a consumer. By resealing the package, packaging 100 may be reusable for continued storage of contents. Resealing also may allow freshness to be extended for a longer period of time for perishable contents. The resealable seal may be transparent or translucent to allow light to penetrate and may be resealable such that the plants can be treated, watered, or otherwise tended and then sealed again. Further, for perishable products, such as food items, the resealable package allows for larger packages to be used by a consumer, without worrying that the product will rot if the entire product is not consumed shortly after opening. Resealable seals and films may be resealed by any sealing type as would be understood by a person having ordinary skill in the art. Exemplary embodiments may include adhesives, hook and loop fasteners, snaps, buttons, zippers, or press-seals. Furthermore, resealable seals and films may be resealable or opened where joined to a frame element, may have a smaller window or resealable opening within the surface area of the film surface, or any combination thereof, as would be understood by a person having ordinary skill in the art.

According to some exemplary embodiments where packaging contents are food items or other perishable items, such as produce, plants, or flowers, products may be harvested and packaged such that they may be ready for consumption. Packaging may be capable of storing at least one live product, such as a plant, insect or animal. In other embodiments, packaging may provide storage for an already-cut or otherwise processed product. The contents may be still alive when placed in the packaging. A consumer may purchase the package and may plant the contents in their own garden, or water the contents in the packaging. The packaging may contain an amount of dirt or other substrate in which the contents may be planted. In other embodiments, the contents may be exposed to substances for promoting growth, such as water or nutrients. This may include roots of contents being secured in or adjacent to a separate compartment or a portion of a main packaging compartment wherein substances for promoting health and growth are disposed. Fresh and fragrant potted living herbs may be placed in a consumer's home and enjoyed for several weeks. Some exemplary embodiments may require a small amount of water daily. Vents along the packaging or a resealable surface film may allow a consumer to water the contained product without compromising the packaging. As a result, a year-round herb garden may be easily provided to consumers. In such embodiments, the root may be left on the plant, enabling the consumer to refrigerate the plant as-is or plant it in a counter/windowsill cup for longer lasting freshness. The transparency of the packaging may allow for a consumer to place the plant near a window and may allow direct sunlight to reach the plant. Further, such a design may provide for easier cutting and/or chopping of the product.

In an exemplary embodiment, the packaging may be configured to interface with one or more control systems. The control systems may autonomously fill the packages with the desired product. For example, a control system may harvest plants directly from an agricultural environment into an optimized packaging. The optimized packaging may thus be shaped such that the control system can easily manipulate one or more packages. Further, the control system may harvest living plants from the agricultural environment, which may then be transplanted into one or more optimized packages. It may be contemplated that the harvested or transplanted plants may continue growing in the optimized packaging. The transparent surfaces and ventilation may be used to allow the plants to continue receiving oxygen and light. It may be contemplated that the ventilation can be configured to allow for watering or misting the plants, or for supplying nutrients to the plants.

According to still further exemplary embodiments, packaging 100 may further have a membrane, which may maintain an internal environment of packaging 100 as desired. For example, a membrane may optionally be breathable and may optionally allow for humidity control and/or the transfer of water or liquids in one or both directions. For example, the membrane may include perforations or micro-perforations, which may facilitate gas exchange. The membrane may be located within packaging 100 forming or separating distinct compartments or may be one or more of films 104. According to some embodiments, the membrane may be a lower breathable membrane.

Figure 3:
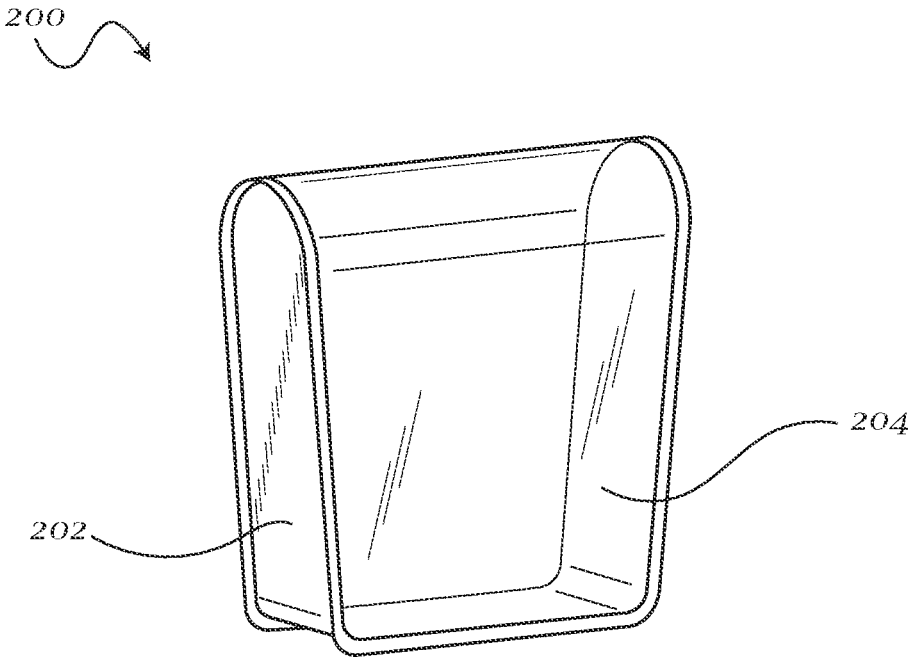
FIG. 3 is another exemplary embodiment of optimized packaging.

Now referring to exemplary FIG. 3, another embodiment of packaging may be provided, container 200. All of the features described with respect to each embodiment referenced herein, including packaging 100 and container 200 may optionally be interchangeable or otherwise implemented in unique combinations, as would be understood by a person having ordinary skill in the art. Container 200 may include a body 202, which may form a partial-perimeter, such as three sides or three walls. Body 202 may form a substantially U-shaped frame, a three-sided frame, or other partial-perimeter frame shape. Container 200 may further have a film element 204, which may seal a perimeter of body 202, forming an enclosed container. Body 202 may optionally be rigid and may provide a structure for a film 204 to seal/form the remaining surfaces or walls. According to an exemplary embodiment, the single film 204 may cover the top, side, and bottom of a container, as shown in FIG. 3. The further elimination or reduction of rigid frame may reduce material and weight without compromising integrity of the container and the protection it provides to contents. Body 202 may optionally be one integral piece or multiple joined pieces and may include one or more flanges, which may accommodate joining of film 204, substantially as described with respect to packaging 100. Film 204 may optionally be re-sealable and may have optional properties as described with respect to film 104. The surface arrangement of film 204 may reduce packaging weight by at least 40%, at least 50%, at least 60%, at least 70%, at least 80%, or at least 90% compared to a similarly sized package of hard plastic or material of frame/body 202. Still further, according to some embodiments, one or more film surfaces 204 may account for at least 10%, at least 20%, at least 30%, at least 40%, at least 50%, at least 60%, at least 70%, at least 80%, or at least 90% of the surface area of packaging 200.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

The invention claimed is:

1. An improved container comprising:

a rigid frame defining a partial perimeter of a cross-section of the improved container and a single film sealed to an edge of the rigid frame forming an enclosed container, wherein the single film forms a top surface, bottom surface, and remaining perimeter of the cross-section of the improved container, wherein a cross-section of the rigid frame is substantially U-shaped, wherein the edge of the rigid frame is a single continuous edge and the single film is sealed along the entire length of the single continuous edge, and wherein the single film forms at least 50% of a surface area of the improved container.

2. The improved container of claim 1, wherein the single film is resealable.

3. The improved container of claim 1, wherein the frame further comprises a flange and wherein the single film is secured to the flange.

4. The improved container of claim 1, wherein the single film is breathable.

5. The improved container of claim 1, wherein the single film is configured to provide reduced weight compared to a material of the rigid frame.

6. The improved container of claim 1, further comprising printed material on the single film.

* * * * *